United States Patent [19]

Lausch

[11] Patent Number: 4,853,596

[45] Date of Patent: Aug. 1, 1989

[54] FLASH DISCHARGE LAMP WITH SINTERED CATHODE MEMBER

[75] Inventor: Michael Lausch, Taunusstein, Fed. Rep. of Germany

[73] Assignee: Heimann GMBH, Fed. Rep. of Germany

[21] Appl. No.: 152,366

[22] Filed: Feb. 4, 1988

[30] Foreign Application Priority Data

Feb. 27, 1987 [DE] Fed. Rep. of Germany ..... 8703095
Mar. 23, 1987 [DE] Fed. Rep. of Germany ..... 8704316

[51] Int. Cl.[4] ..... H01J 61/06
[52] U.S. Cl. ..... 313/632; 313/346 R
[58] Field of Search ..... 313/632, 630, 631, 346 R, 313/627

[56] References Cited

U.S. PATENT DOCUMENTS 2,886,737 5/1959 Fruengel ..... 313/631 X
3,849,690 11/1974 Cosco et al. ..... 313/632 X
3,916,241 10/1975 Pollard ..... 313/630 X
4,315,187 2/1982 Chow ..... 313/631 X
4,672,268 6/1987 Duenisch et al. ..... 313/632 X
4,739,221 4/1988 Achter et al. ..... 313/632

FOREIGN PATENT DOCUMENTS 1031421 6/1958 Fed. Rep. of Germany .
1328330 4/1963 France ..... 313/630
58-10676 11/1984 Japan .
2171554A 11/1985 United Kingdom .

*Primary Examiner*—Palmer C. DeMeo
*Attorney, Agent, or Firm*—Hill, Van Santen, Steadman & Simpson

[57] ABSTRACT

A cathode is formed such that a blackening of the inside wall of the discharge tube due to evaporated material does not occur and good heat transmission occurs. A base member (5) is provided to which a green sintered member (7) is pressed on said base member under high pressure and is then sintered which reduces its size. Soldering or welding is thus accordingly avoided. The volume of the sintered member (7) is significantly smaller than the volume of the base member (5).

1 Claim, 1 Drawing Sheet

FLASH DISCHARGE LAMP WITH SINTERED CATHODE MEMBER

CROSS-REFERENCE TO RELATED APPLICATION

This application is related to application Ser. No. 863,857 filed May 16, 1986 U.S. Pat. No. 4,739,221 which issued on Apr. 19, 1988. entitled "Gas Discharge Lamp With A Sintered Cathode Member Fused To A Lead And The Method of Manufacture" in which the inventors are Eugen Achter and Michael Lausch assigned to the assignee of the present application.

BACKGROUND OF THE INVENTION

1. Field of the Invention

The invention is directed to a flash discharge lamp which contains two electrodes and a gas filled light transmissive housing and wherein the cathode is composed of a base member and a sintered member which is attached to the base member and the sintered member is formed with an opening in which the base member is received.

2. Description of the Prior Art

It is known to join the sintered member to the base member by soldering or welding. During soldering, the solder penetrates the porous sintered member and evaporates due to the high plasma temperatures of about 8000° Kelvin occurring during a flash discharge. The discharge tube is blackened and this leads to a considerable reduction in the light output over the life of the flash discharge lamp. Optimum heat transmission between the sintered member and the base member is not assures when using welding.

Other prior art comprises U.S. Pat. No. 3,916,241, Japanese Patent Abstract JPA No. 59-848, German Pat. No. 1,031,421 and British Pat. No. 2,171,554.

SUMMARY OF THE INVENTION

It is an object of the present invention to provide a flash discharge lamp wherein blackening of the inside wall of the discharge tube due to evaporated material is reduced as compared to the prior art and wherein good heat transmissivity occurs between the sintered member and the base member.

The object of the invention is achieved in that the green member which is to be sintered is pressed onto the base member under high pressure and is formed with an opening for this purpose through which the base member extends. Then the green sintered member is sintered which results in an intimate bond between the sintered member and the base member due to a slight decrease in dimension of the opening in the sintered member which occurs during the sintering process. This also makes a very intimate bond between the sintered member and the base member which increases the heat transmission between the members, thus, resulting in optimum transfer of heat.

An expedient development of the invention is that the total volume of the sintered member is significantly smaller than the volume of the base member and a high stability under load of the cathode results.

Other objects, features, and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
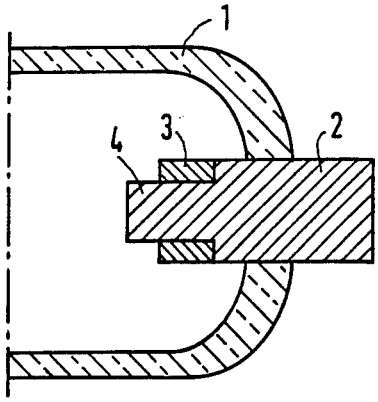
FIG. 1 is a sectional view of a first embodiment of the invention and shows the cathode end of a flash discharge lamp mounted in a glass tube.

FIG. 1 is a sectional view through a flash discharge lamp which has a glass envelope or tube 1. Only the cathode end of the flash discharge lamp is shown and the anode end may be a conventional structure.

As shown in FIG. 1, a base 2, which might be generally cylindrical shaped, is formed with a reduced cross-sectional portion 4 that extends into the inside of the tube 1 and is fused to the glass tube as shown. A hollow cylindrical sintered member 3 is formed with a central opening and is placed over the projection 4 of the body member 2 as shown. The green sintered member 3 is placed on the projection 4 and the green sintered member 3 is sintered which then reduces the green sintered member 3 is size which causes it to be very tightly mounted on the projection 4. The body member 4 is fused to the glass tube 1.

Figure 2:
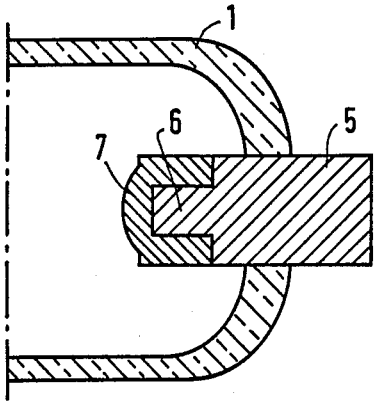
FIG. 2 is a sectional view through a flash discharge lamp according to the invention of a modification of the invention.

FIG. 2 is a sectional view of the cathode end of a glass tube 1 and illustrates a second embodiment wherein the body member 5 is fused to the glass envelope 1 and a green sintered member 7 is generally cap or cup-shaped and is formed with an internal opening into which the projection 6 can be received. Then the green sintered member 7 is sintered so as to reduce its inside diameter so as to form a very tight fit with the projection 6 of the base member 5.

The base member 2 in FIG. 1 and 5 in FIG. 2 may be formed of thoriated tungsten.

Figure 3:
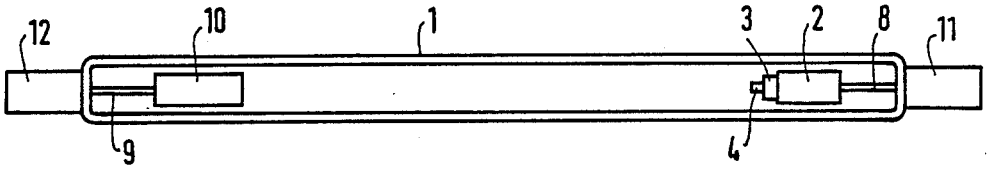
FIG. 3 illustrates in section another embodiment of the invention.

In the examples of FIGS. 1 and 2, the base member 2 and the base member 5 are tightly fused into the glass member 1. This is possible when the glass tube 1 has a large diameter relative to the diameter of the base member 2 or 5. If a small diameter glass tube 1 is utilized, the embodiment of FIG. 3 can be utilized wherein a small thin electrode wire 8 is fused into one end of the glass tube 1 and the base member 2 is attached to the end of the thin electrode wire 8 inside the tube and substantially fills the clearance of the glass tube 1 as shown in FIG. 3. In FIG. 3, the base member 2 has the shape of the one shown in FIG. 1 and is formed with a projection 4 onto which the sintered member 3 is placed. FIG. 3 illustrates the electrode wire 8 which is fused into the glass tube 1 and is connected to the base member 2 in the inside of the tube such that an electrical path exists from terminal 11 outside of the tube to the base member 2 within the tube.

FIG. 3 also illustrates the anode end of the flash discharge lamp which includes an anode member 10 which is mounted on a wire 9 so that it makes electrical contact. The wire 9 is fused into the glass tube 1 and is connected electrically to an external lead 12 on the outside of the tube.

It is seen that the present invention provides a novel cathode electrode which is formed by placing a green sintered member over a projection of a body member and then the sintered member which is sintered reduces it in volume and, thus, provides a tight fit between the sintered member and the projection of the body member thus resulting in a very good thermal conductivity between the sintered member and the body member.

Although the invention has been described with respect to preferred embodiments, it is not to be so limited as changes and modifications can be made which are within the full intended scope of the invention as defined by the appended claims.

I claim as my invention:

1. A flash discharge lamp that contains anode and cathode electrodes mounted in a gas-filled, light-transmissive housing (1), whereby the cathode (2-7) is composed of a base member (2, 5) which has an extending projection (4, 6) and of a sintered member (3, 7) which is mounted on the base member and where said sintered member (3, 7) is provided with an opening into which said extending projection (4, 6) of said base member (2, 5) extends, characterized in that said sintered member (3, 7) is pressed onto said extending projection of said base member (2, 5) under high pressure and is then sintered which reduces its size thus causing a tight fit between the sintered member and the base member, and in that the volume of said sintered member (3, 7) is significantly smaller than the volume of said base member (2, 5).

* * * * *